United States Patent [19]

Olschansky et al.

[11] Patent Number: 4,600,189

[45] Date of Patent: Jul. 15, 1986

[54] MULTI-FUNCTION EXERCISE SYSTEM

[75] Inventors: Brad Olschansky; Scott Olschansky, both of Timonium, Md.

[73] Assignee: Lifeing, Inc., Sparks, Md.

[21] Appl. No.: 597,731

[22] Filed: Apr. 11, 1984

[51] Int. Cl.[4] ..... A63B 21/06

[52] U.S. Cl. ..... 272/118; 272/134; 272/144; 272/DIG. 4

[58] Field of Search ..... 272/118, 130, 134, 144, 272/72, 117, DIG. 4; 128/25 R, 33; 297/377

[56] References Cited

U.S. PATENT DOCUMENTS

| | | | |
|---|---|---|---|
| 1,028,956 | 6/1912 | Peterson | 297/377 |
| 2,777,439 | 1/1957 | Tuttle | 128/25 R |
| 3,374,675 | 3/1968 | Keropian | 272/130 |
| 3,647,209 | 3/1972 | La Lanne | 272/118 |
| 3,708,116 | 1/1973 | Annas | 272/118 X |
| 3,912,263 | 10/1975 | Yatso | 272/DIG. 4 X |
| 4,226,414 | 10/1980 | Coffard et al. | 272/117 |
| 4,240,626 | 12/1980 | Lambert, Jr. | 272/118 |
| 4,275,882 | 6/1981 | Grosser et al. | 272/130 X |
| 4,317,566 | 3/1982 | Uyeda et al. | 272/118 |
| 4,407,495 | 10/1983 | Wilson | 272/DIG. 4 X |
| 4,478,411 | 10/1984 | Baldwin | 272/118 |
| 4,500,089 | 2/1985 | Jones | 272/117 |

*Primary Examiner*—Richard J. Apley
*Assistant Examiner*—Robert W. Bahr
*Attorney, Agent, or Firm*—Morton J. Rosenberg

[57] ABSTRACT

A multi-function exercise system (10) for reversibly displacing weight elements (12) in a substantially vertical direction (14) responsive to a lifting force imparted to the weight elements (12) by a user. The exercise system (10) includes an actuating bar mechanism (38) which is rotatively displaced to responsively rotate a rotative pulley mechanism (30) which is coupled to the weight elements (12) and provide a lifting force responsive to the rotative displacement of the actuating bar mechanism (38). The actuating bar mechanism (38) may by angularly oriented in a predetermined relation with respect to a first pulley axis (32) passing normal to vertical direction (14). Additionally, rotative pulley mechanism (30) may be vertically adjusted with respect to the base frame (18) of the exercise system in order to accomodate the user applying a rotative force to the actuating bar mechanism (38) by different parts of his or her body.

19 Claims, 10 Drawing Figures

FIG. 1
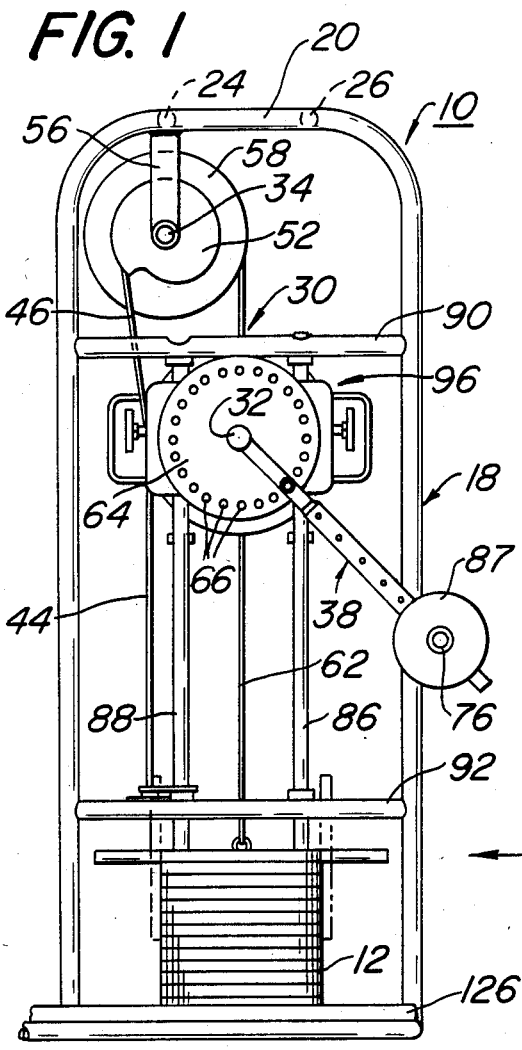
FIG. 2
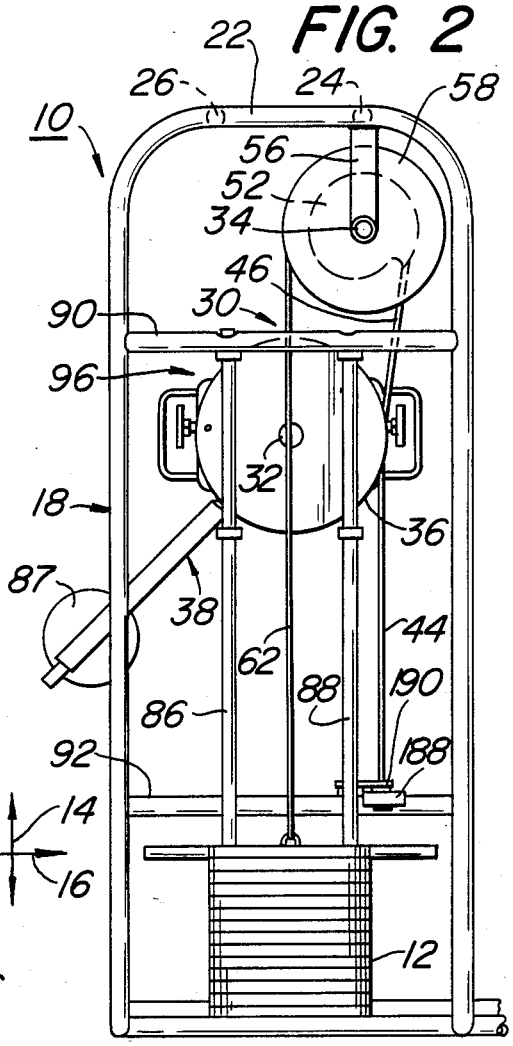
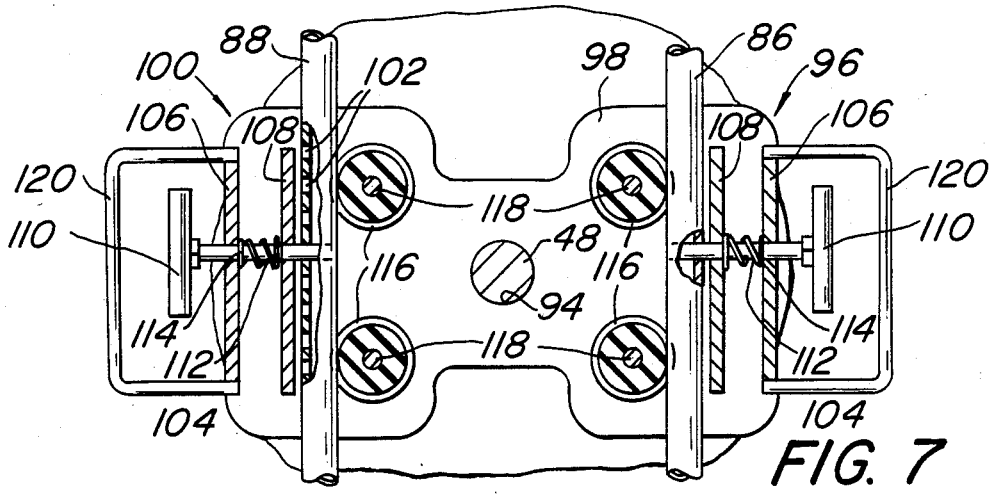
FIG. 7

FIG. 3
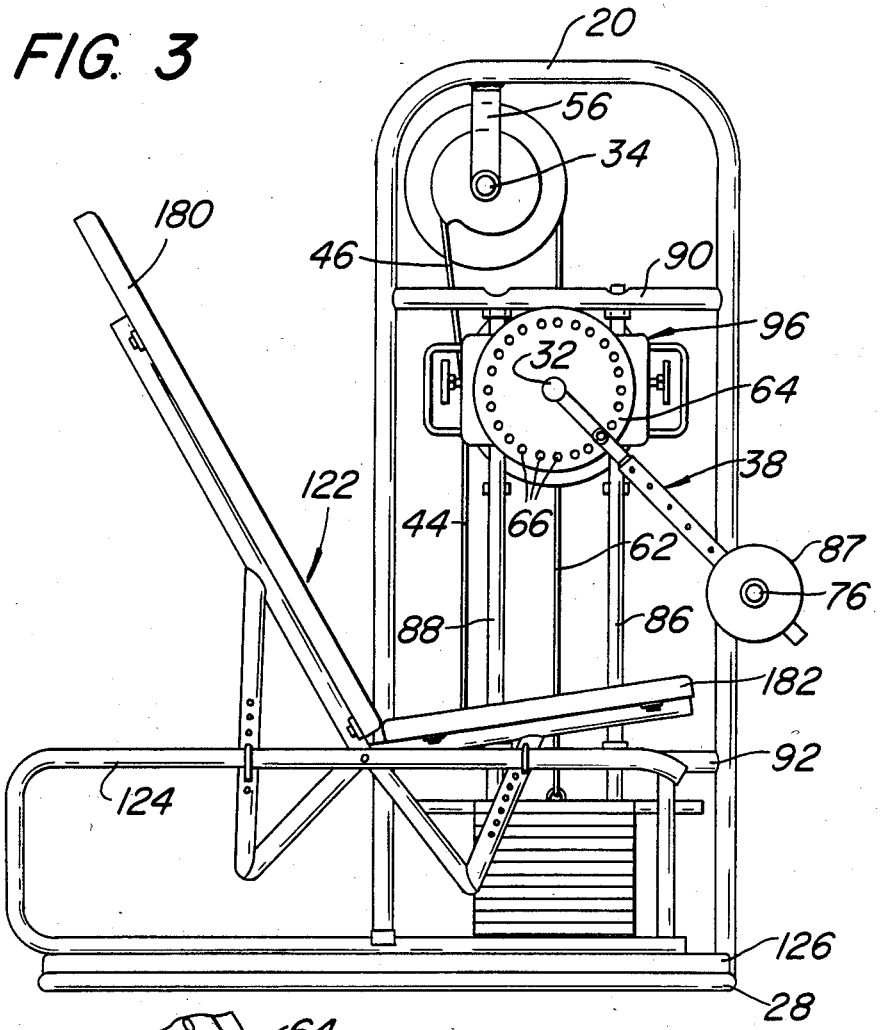
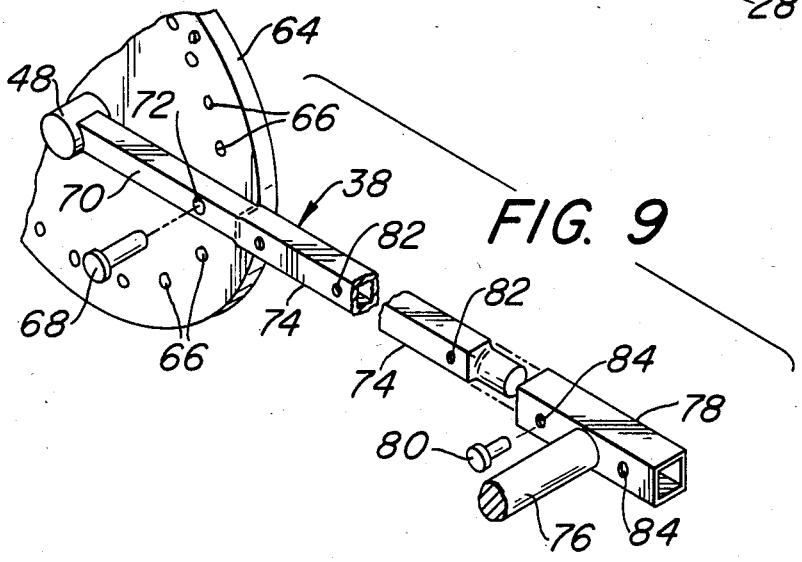
FIG. 9

FIG. 4
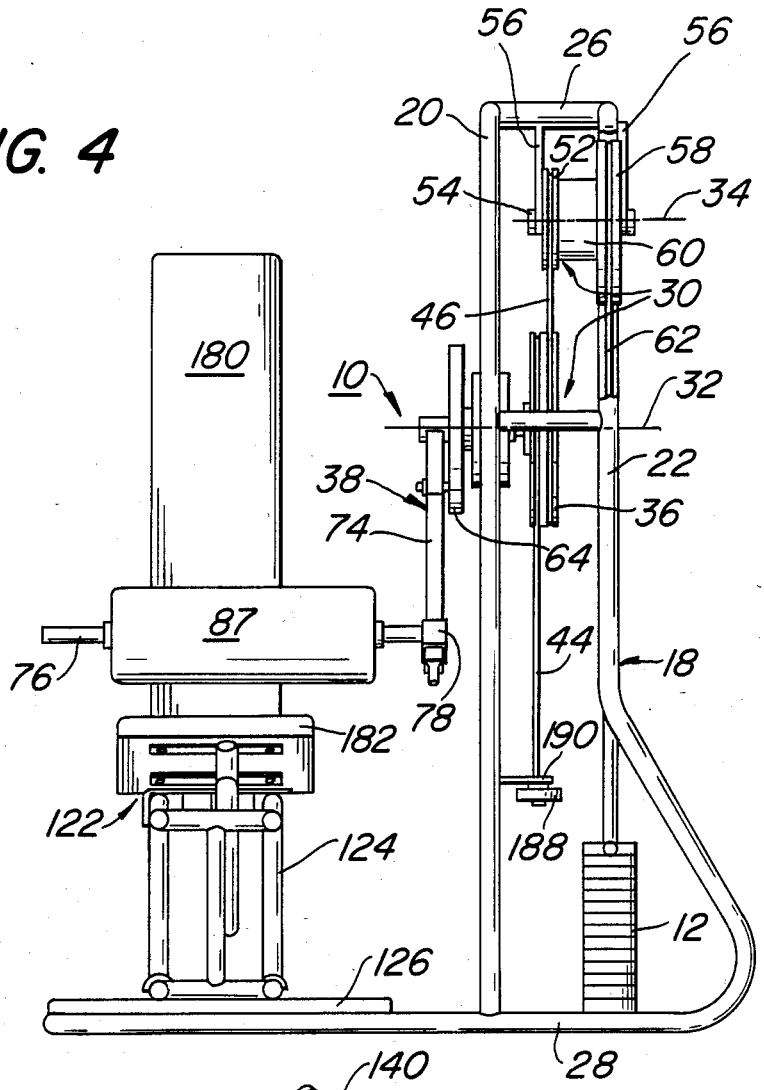
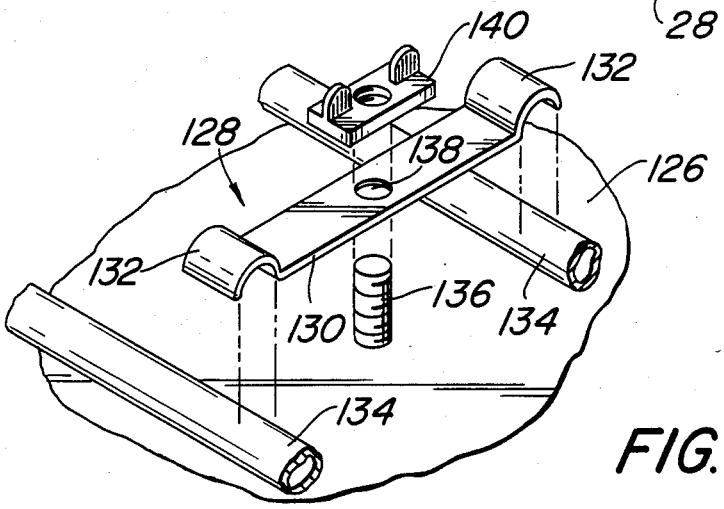
FIG. 8

MULTI-FUNCTION EXERCISE SYSTEM

BACKGROUND OF THE INVENTION

1. Field of the Invention

This invention is directed to an exercise system. In particular, this invention is related to a multifunction exercise system wherein a user may exercise different portions of his or her body. Still further, this invention is related to an exercise system which includes a rotatively actuated bar mechanism utilized in combination with a pulley system for reversibly lifting weight elements. More in particular, this invention is directed to an exercise system wherein a rotatively displaceable actuating bar mechanism may be oriented at a predetermined initial angle. Additionally, this invention is directed to an exercise system which includes an actuating bar mechanism which may be linearly adjustable in a radial direction with respect to an axis about which the actuating bar mechanism is rotatively displaced. More in particular, this invention directs itself to an exercise system where an actuating bar mechanism is coupled to a rotative pulley mechanism which is vertically adjustable by a user to provide an adjustable height for a load imparting force applied by a user.

2. Prior Art

Exercise systems using resistance force arms to lift weight elements are known in the art. However, in some such prior art systems, the resistance arm member is not adjustable in angular orientation to accomodate different portions of a person's body when applying a rotatable displacement of force thereon. Additionally, other prior art exercise systems do not provide for a vertically displaceable pulley system which accomodates differing heights and differing body dimensions of persons applying the resistive force for lifting the weight elements.

Other prior art exercising systems do not provide for an adjustable seat mechanism for permitting the user to apply the resistance forces to the resistance force arm members when in a sitting position. Still other prior art exercise systems do not provide for a movable seat mechanism to provide differing orientations for a user applying the force loading.

The closest prior art known to the Applicant is an exercise system which does utilize a rotative force resistance arm member. This prior art exercise machine is produced by Universal, a subsidiary of Kidde, Inc. However, this prior art exercise machine is not believed to provide a vertically adjustable pulley system. Additionally, this prior art exercise system is not believed to provide for an adjustable rotative pulley system, as is provided by the subject invention concept. Still further, this prior art exercise system is based on a platform principle, wherein the user stands on the platform and applies rotative displacement forces to the force resisting arm member. However, it is not believed that this prior art exercising system accomodates in combination a seating mechanism for allowing the user to apply the forces to the force resisting arm member when in a seated position.

SUMMARY OF THE INVENTION

A multi-function exercise system for reversibly displacing at least one weight element in a substantially vertical direction responsive to a lifting force imparted to the weight element by a user. The multi-function exercise system includes a base frame as well as a rotative pulley mechanism displaceably coupled to the base frame and the weight element. The rotative pulley mechanism includes a first pulley axis and a second pulley axis. An actuating bar mechanism is coupled to the rotative pulley mechanism for rotationally displacing the rotative pulley mechanism responsive to a rotative force applied by the user. Additionally, the exercise system includes a mechanism for vertically adjusting the rotative pulley mechanism with respect to the base frame.

BRIEF DESCRIPTION OF THE DRAWINGS

FIG. 1 is directed to a front view of the multifunction exercise system;

FIG. 2 is a rear view of the multi-function exercise system;

FIG. 3 is a frontal view of the multi-function exercise system showing the multi-function exercise system in combination with a seating mechanism;

FIG. 4 is an elevational view of the multi-function exercise system in combination with a seating mechanism;

FIG. 7 is a sectional view of the vertically adjustable rotative pulley mechanism taken along the section line 7—7 of FIG. 5;

FIG. 8 is a perspective view of the seating mechanism adjustability elements;

FIG. 9 is a perspective view partially cut away of the linearly adjustable mechanism of the actuating bar system; and, FIG. 10 is an elevational view of an embodiment of the multi-function exercise system.

DESCRIPTION OF THE PREFERRED EMBODIMENTS

Figure 5:
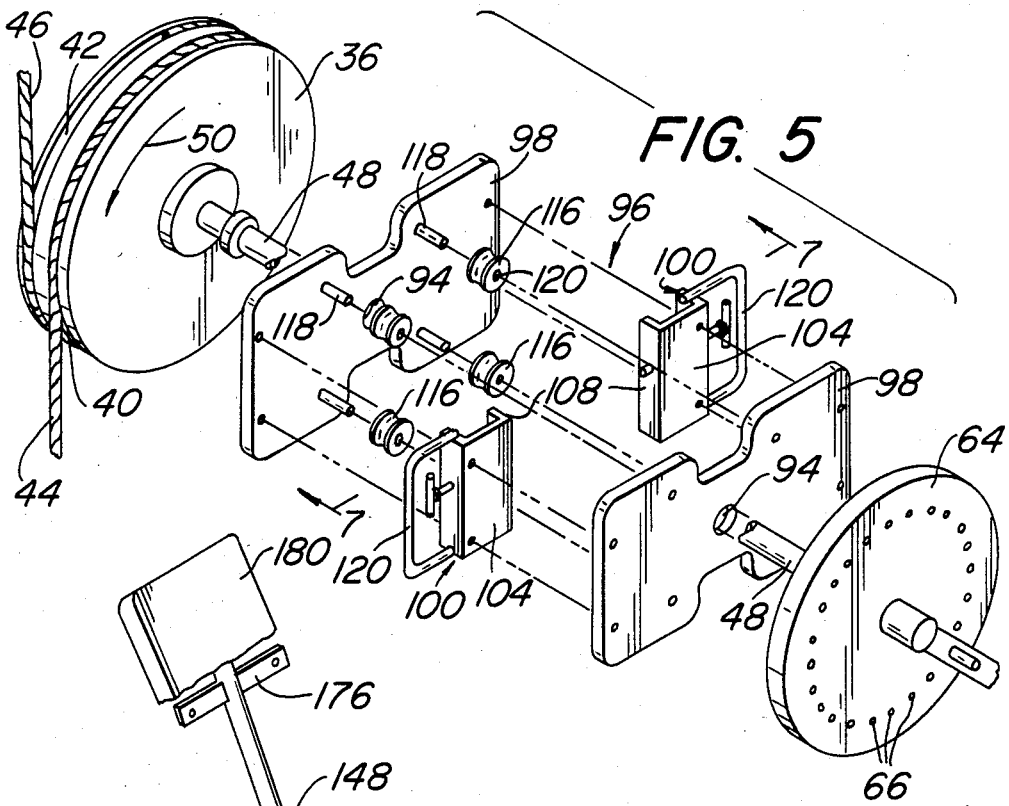
FIG. 5 is an exploded perspective view of the vertical adjustable mechanism for the rotative pulley mechanism.

Referring now to FIGS. 1, 2, 4, and 10, there is shown multi-function exercise system 10 for reversibly displacing weight and/or force resistive elements 12 in substantially vertical direction 14 responsive to a lifting force imparted to weight elements 12 by a user.

In overall concept, exercise system 10, at the user's discretion, may be used for a multiplicity of purposes, for exercise of different muscles in a user's body. In particular, exercise system 10 provides for adjustability of orientation of lifting force orientations by the user to provide for arm lifting capabilities, as well as leg imparted forces. Additionally, as will be seen in following paragraphs, multi-function exercise system 10 provides for an adjustable seating arrangement for the user which allows a plurality of orientations and positional locations of the seating mechanism to provide the user with the capability of exercising differing muscles in his/her body.

Multi-function exercise system 10 includes base frame 18 which includes generally U-shaped frontal tubing 20 and rearwardly displaced U-shaped back tubing 22, clearly seen in FIGS. 1 and 2. U-shaped frontal tubing 20 and U-shaped back tubing 22 are rigidly coupled each to the other by a pair of support rods 24 and 26 for coupling tubing 20 and 22 at an upper portion of base frame 18, as is seen in FIGS. 1, 2 and 4. Support rods 24 and 26 may be secured on opposing ends to respective frontal and back tubing 20 and 22 by welding, threaded securement, or some like means, not important to the inventive concept as is herein described.

As is seen in FIG. 4, U-shaped back tubing 22 is inverted in positional location and extends to L-shaped section tubing 28 which extends forward of base frame 18, as is seen, in order to provide stability for the overall system, as well as to provide a mount for a seating mechanism to be described in following paragraphs. U-shaped frontal and back tubing 20 and 22 as well as support rods 24 and 26 and L-shaped section tubing 28 may be formed of stainless steel, or some like metal composition, not important to the inventive concept as is herein described, with the exception that such must maintain structural integrity responsive to the loads being imparted to multi-function exercise system 10 by the user.

Exercise system 10 includes rotative pulley mechanism 30 which is displaceably coupled to base frame 18 and weight elements 12. Rotative pulley mechanism 30 includes first pulley axis 32 and second pulley axis 34. As will be seen, rotative pulley mechanism 30 and associated elements may be vertically displaced in vertical direction 14, as a function of the desired positional location by a user.

Referring now to FIGS. 1, 2, 3, 4, and 10, rotative pulley mechanism 30 is seen to include first pulley member 36 which, as will be seen in following paragraphs, is secured to base frame 18 and further secured to actuating bar mechanism 38. First pulley member 36 is rotatably actuated or displaced by actuating bar mechanism 38 about first pulley axis 32. As seen in FIG. 5, first pulley member 36 includes first groove 40 and second groove 42 within which there is guided first cable 44 and second cable 46, respectively. First pulley member 36 is rigidly fixed to first pulley shaft 48 as is seen in FIG. 5. Each of first cable member 44 and second cable member 46 are fixedly secured on one end thereof to a portion of respective first and second grooves 40 and 42 through welding, bolting, or some like technique, not important to the inventive concept as herein described. Thus, rotation of first pulley member 36 in a counter-clockwise direction depicted by directional arrow 50 in FIG. 5 provides for a linear downward displacement of second cable member 46 and a similar downward movement or displacement of first cable member 44.

Second pulley member 52 is rotatively coupled to first pulley member 36 and is rotatable about second pulley axis 34. Second pulley member 52 is coupled to first pulley member 36 through second cable member 46, which is fixedly secured within a groove portion of second pulley member 52. Second pulley member 52 includes second pulley shaft 54 upon which second pulley member 52 is rotatably displaceable. Second pulley shaft 54 is rigidly coupled to base frame 18 through vertically extending flanges 56 which are rigidly secured to U-shaped frontal and back tubing 20 and 22 as well as support rod 26. Vertically extending flanges 56 may be fixedly secured through welding, bolting, or some like technique, not important to the inventive concept as herein described. The important concept being that second pulley member 52 is free to be rotatively actuated about second pulley axis 34 responsive to a rotative displacement of first pulley member 36 by way of force loading applied through second cable 46.

As is clearly seen in FIGS. 1, 2 and 3, second pulley member 52 is arcuately contoured and may be given a contour such as an elliptical contour to provide a varying force responsive to a rotative displacement of actuating bar mechanism 38 resulting in differing force loadings applied to weight elements 12 dependent upon the particular orientation and angular displacement of rotative pulley mechanism 30. Where second pulley member 52 is circular in overall contour, the force loading applied to weight elements 12 will be substantially constant throughout a rotative displacement of pulley mechanism 30. However, by arcuately contouring second pulley member 52 in a manner non-circular, a varying force load may be applied to weight elements 12 at particular orientations and displacements of actuating bar mechanism 38.

Third pulley member 58 is secured to second pulley member 52 through spacer member 60 and is rotatively displaceable about second pulley axis 34 on second pulley shaft 54. Third pulley member 58 may be coupled to second pulley member 52 through securement on opposing ends thereof of spacer member 60 by welding, bolting, or some like technique. Spacer member 60 is also free to be rotatably actuated on second pulley shaft 54 to provide a concurrent rotation of second pulley member 52 and third pulley member 58 responsive to a rotation displacement of first pulley member 36. Third cable member 62 is secured on opposing ends thereof to weight elements 12 and to third pulley member 58. Thus, rotation of first pulley member 36 in counter-clockwise direction 50 as is shown in FIG. 5, results in a responsive rotation of second pulley member 52 and third pulley member 58 causing a tension loading on third cable member 62 which force loads weight elements 12 in an upward direction, as is seen in FIGS. 1, 2 and 4.

Exercise system 10 includes a mechanism for rotationally adjusting actuating bar mechanism 38 with respect to rotative pulley mechanism 30 about first pulley axis 32. The mechanism for rotationally adjusting actuating bar mechanism 38 includes disk member 64 which is coupled to rotative pulley mechanism 30 through a fixed coupling to first pulley shaft 48, as can be clearly seen in FIG. 5. Thus, first pulley shaft 48 may be fixedly secured to disk member 64 by force fit, welding, or some like technique, not important to the inventive concept as herein described, with the exception that responsive to a rotation of disk member 64, there is a responsive rotation of first pulley shaft 48 to rotatively drive first pulley member 36. In this manner, a rotational displacement of disk member 64 through a predetermined angular displacement results in a similar angular displacement of first pulley member 36 which responsively acts and rotatively drives second pulley member 52 coupled to third pulley member 58 causing a lifting force to be imparted on weight elements 12.

Disk member 64 further includes a plurality of arcuately displaced openings 66 formed through the overall disk-shaped contour. Thus, disk member openings 66 have an axis line substantially parallel to first pulley axis 32 and pass through disk member 64.

The mechanism for rotationally adjusting actuating bar mechanism 38 further includes a mechanism for releasably coupling actuating bar mechanism 38 to disk member 64. Referring now to FIG. 9, there is clearly seen actuating bar mechanism 38 including first actuating bar member 70 which is coupled in fixed securement to rotative pulley mechanism 30 by fixed securement with the end of shaft 48 and first actuating bar member 70 extends in a direction substantially normal first pulley axis 32. Actuating bar pin member 68 is insertable within bar opening 72 which is alignable with one of disk member openings 66, as is clearly seen in FIG. 9. Thus, the angular orientation of first actuating bar member 70 of actuating bar mechanism 38 may be angularly oriented at the discretion of the user by insert of actuating bar pin member 68 into a predetermined disk member opening 66. Thus, in operation, when a user wishes to orient actuating bar mechanism 38 in an initial position for a particular exercise, first actuating bar member 70 is rotated until alignment is achieved between bar opening 72 and a predetermined disk member opening 66. Subsequent to the alignment phase, actuating bar pin member 68 is inserted through bar opening 72 into the predetermined disk member opening 66 for capturing and restraining first actuating bar member 70 to disk member 64. As previously described, rotation of first actuating bar member 70 thus results in rotation of first pulley member 36, second pulley member 52, and third pulley member 58 to achieve a lifting force on weights 12.

Exercise system 10 further includes a mechanism for linearly adjusting actuating bar mechanism 38 in a direction substantially normal to first pulley axis 32. The mechanism for linearly adjusting actuating bar mechanism 38 includes previously described first actuating bar member 70 which is coupled to rotative pulley mechanism 30 and extends in the direction substantially normal to first pulley axis 32, as is clearly seen in FIG. 9. Additionally, the mechanism for linearly adjusting actuating bar mechanism 30 includes second actuating tubular member 74 which is slidingly displaceable on first actuating bar member 70 and may be fixed thereto through bolts, pin member insert, or other like securing mechanism, not important to the inventive concept as herein described.

Actuating bar mechanism 38 further includes user interface bar member 76 which is secured to second actuating tubular member 74 through insert of third tubular member 78 into engagement with second actuating tubular member 74, as is shown in FIG. 9. Third tubular member 78 may be coupled to second actuating tubular member 74 by tubular pin member 80 or by some like technique. As can be seen, user interface bar member 76 extends substantially in first pulley axis direction 32. The important concept being that first actuating bar member 70, second actuating tubular member 74, and third tubular member 78 may be relatively displaced in a radial direction taken with respect to first pulley axis 32. Alignment of openings 82 with openings 84 formed in third tubular member 78 allows insert of tubular pin member 84 relative adjustment and dimensional control of the linear extension of user interface bar member 76 from first pulley axis 32. Alternatively and not departing from the inventive concept first actuating bar member 70 may be formed in one-piece formation with second actuating tubular member 74 while allowing third tubular member 78 to be displaced on the combination.

As can be seen in FIGS. 1, 2, 3 and 4, user interface bar member 76 has mounted thereto user interface pad 87 which is formed of a resilient material such as leather having a foam core, or some like composition, which provides for a resilient interface of the user's body with actuating bar mechanism 38.

Exercise system 10 includes a mechanism for vertically adjusting rotative pulley mechanism 30. The mechanism for vertically adjusting rotative pulley mechanism 30 includes a pair of transversely displaced vertically extending post members 86 and 88 secured to base frame 18. As can be seen in FIGS. 1 and 2, post members 86 and 88 are fixedly secured to upper and lower support tubing members 90 and 92. Upper and lower support tubing 90 and 92 may be rigidly secured to U-shaped frontal and back tubing 20 and 22 through welding, threaded securement, or some like mechanism. In this manner, there is provided transversely displaced post members 88 and 86 which extend substantially in vertical direction 14 and which are fixedly secured to base frame 18.

The mechanism for vertically adjusting rotative pulley mechanism 30 further includes releasable coupling mechanism 96 for permitting a releasable coupling of rotative pulley mechanism 30 to transversely displace post members 86 and 88, as is shown in FIGS. 5 and 7. Releasable coupling mechanism 96 includes a pair of adjustment plate members 98 positionally located on opposing sides of post members 86 and 88. Rotative pulley mechanism 30 includes first pulley shaft 48 which extends through adjustment plate members 98 in a direction coincident with first pulley axis 32. First pulley shaft 48 of rotative pulley mechanism 30 passes through openings 94 and which include diameters slightly greater than the diameter of first pulley shaft 48 in order to allow rotative displacement therebetween. Additionally, releasable coupling mechanism 96 further includes spring loaded adjustment mechanism 100 which is mounted between adjustment plate members 98 for releasably engaging openings 102 formed in transversely displaced post members 86 and 88.

Spring loaded adjustment mechanism 100 further includes U-shaped channel members 104 having opposing leg members 106 and 108. Spring biased pin member 110 extends through opposing leg members 106 and 108 for insert into at least one of openings 102 in post members 86 and 88. As can be seen, spring biased pin member 110 includes coil spring member 112 which may act on collar member 114 secured to pin member 110. In this manner, spring biased pin member 110 may be inserted into openings 102 or removed therefrom. Additionally, in order to capture spring loaded adjustment mechanism 100 to posts 86 and 88, there is provided roller bearings 116 which are inserted over pin members 118 secured to adjustment plate 98. Pin members 118 have a diameter equal to or slightly less than the diameter of through openings 120 of roller bearing members 116. In this manner, roller bearing members 116 may be rotatably displaceable with respect to pin members 118 and provide for rolling contact on post members 86 and 88, as spring loaded adjustment mechanism 100 is displaceably moved in vertical direction 14. Spring loaded adjustment mechanism 100 further includes handle members 120 which are U-shaped members coupled to leg members 106 of opposing releasable coupling mechanisms 96. In this manner, releasable coupling mechanism 96 may be released from posts 86 and 88 by retraction of spring biased pin members 110. Handle members 120 are grasped and releasable coupling mechanism 96 may be raised or lowered, at the discretion of the user in vertical direction 14. When releasable couping mechanism 96 is movably displaced on post members 86 and 88, first pulley shaft 48 is similarly vertically displaced, which displaces first pulley member 36 as well as disk member 64 to provide a responsive vertical displacement of rotative pulley mechanism 30.

Figure 6:
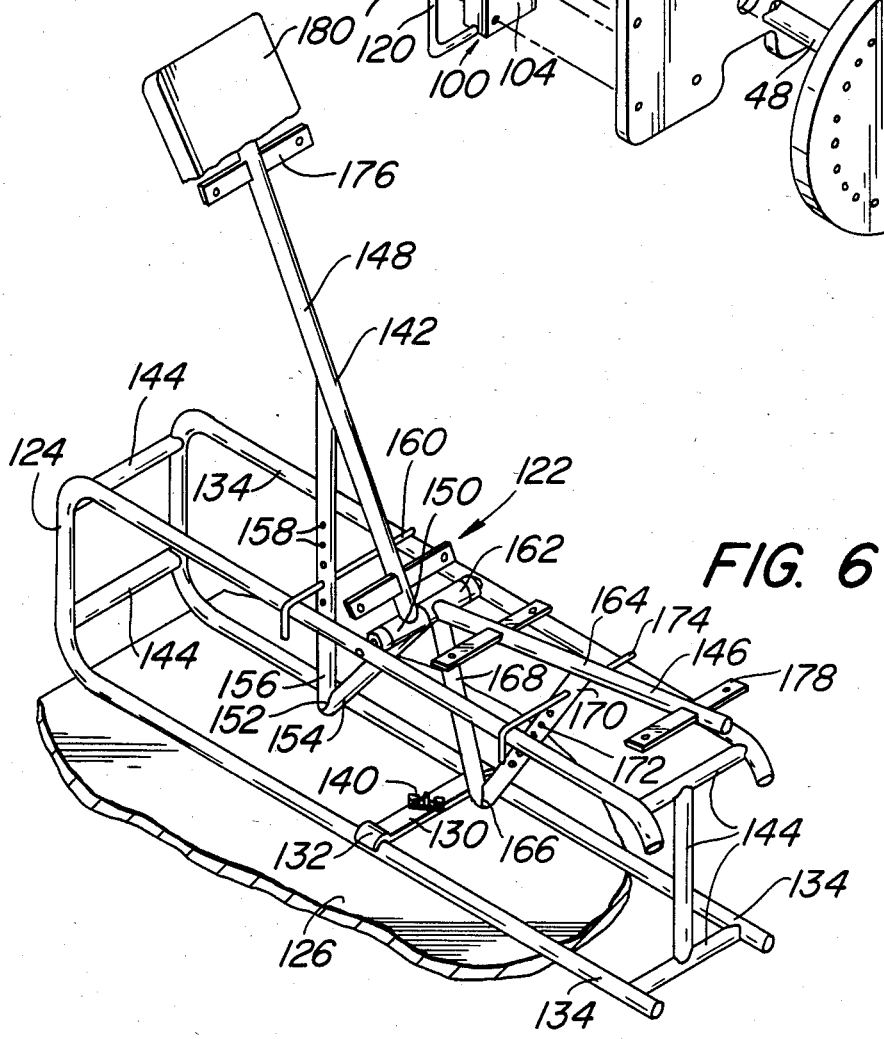
FIG. 6 is a perspective view, partially cut-away of the seating mechanism associated with the multi-function exercise system.

Referring now to FIGS. 3, 4, and 6, it is seen that multi-function exercise system 10 further includes seat mechanism 122 which is displaceable in transverse direction 16 with respect to base frame 18 for allowing adjustment of a user's positional location with respect to base frame 18. Seat mechanism 122 includes seat frame 124 which is mounted on floor or base member 126. Floor or base member 126 may be planar in contour, and as is seen in FIGS. 3 and 4, may lie and extend in transverse direction on L-shaped sectional tubing 28 of base frame 18.

Seat mechanism 122 further includes releasable locking mechanism 128 as is shown in FIG. 8 to releasably lock seat mechanism 122 to base or floor member 126. Releasable locking mechanism 128 includes clamp member 130 having opposing C-shaped end sections 132 for passage over and interfaced with a pair of transversely extending and displaced seat rod members 134 of seat frame 124. Threaded bolt member 136 is secured to base or floor member 126 and extends through opening 138 formed through clamp member 130. Threaded bolt member 136 is adapted to engage nut member 140 and may be threaded on threaded bolt member 136 to force clamp member 130 into engagement with rod members 134 and secure seat frame 124 and consequently seat mechanism 122 into a frictionally locked condition with respect to floor or base member 126.

Seat mechanism 122 of exercise system 10 includes frame back portion 142 which is rotatively coupled to seat frame 124 about an axis line substantially parallel but displaced from first pulley axis 32. As can be seen, seat frame 124 includes U-shaped rod members 134 which are coupled together by seat frame support rods 144. Seat frame support members 144 may be rigidly secured each to the other and to rod members 134 by bolting, welding, or some like technique, not important to the inventive concept as herein described.

Seat mechanism 122 further includes frame seat portion 146 which is rotatively coupled to seat frame 124 about a coincident axis line with respect to the axis line of seat frame back portion 142. Thus, frame seat portion 146 and frame back portion 142 are rotatably coupled about the same axis line when taken with respect to seat frame 124.

Frame back portion 142 includes seat back bar member 148 which is rotatably secured to seat frame 124 and specifically to opposing rod members 134, as is seen in FIG. 6. Seat back bar member 148 extends to bearing member 150 which is rotatably secured to rod members 134. Frame back portion 142 further includes V-shaped seat back bar member 152 having intersecting legs 154 and 156. Leg or arm member 156 includes a plurality of displaced openings 158 formed therethrough. Back seat pin member 160 is insertable through one of openings 158 and dependent upon the particular opening 158 through which back seat pin member 160 extends and contacts opposing rod members 134, it is clearly seen that frame back portion 142 of seat mechanism 122 may be rotatively oriented to a predetermined position responsive to the needs of a user.

Similarly, seat mechanism 122 includes frame seat portion 146 which is rotatively coupled to seat frame 124 about a coincident axis line of frame back portion 142. Frame seat portion 146 is coupled in rotative displacement to rod members 134 by bearing 162 which permits for relative rotation of frame seat portion 146 with respect to seat frame 124.

Frame seat portion 146 includes seat bar member 164 which is rotatively secured to seat frame 124. V-shaped seat bar member 166 is secured to seat bar member 164 on opposing ends of arms 168 and 170. Arm member 170 includes a plurality of openings 172 passing therethrough and adapted for insert of seat pin 174. Seat pin member 174, as is clearly seen in FIG. 6, contacts opposing rod members 134 of seat frame 124 to stabilize frame seat portion 146 at a particular angular orientation with respect to transverse direction 16. In this manner, by insert of seat pin member 174 through a particular opening 172 in arm member 170 of V-shaped seat bar member 166, the angular inclination of frame seat portion 146 may be adjusted to a particular desired angular orientation of the user.

Back bar members 176 and seat bar members 178 as is seen in FIG. 6, may be secured respectively to seat back bar member 148 and seat bar member 164 to provide structure wherein back pad member 180 may be mounted to seat back bar member 148 and back bar member 176. Similarly, seat pad member 182 may be mounted and secured to seat bar member 164 and seat bar member 178.

Figure 10:
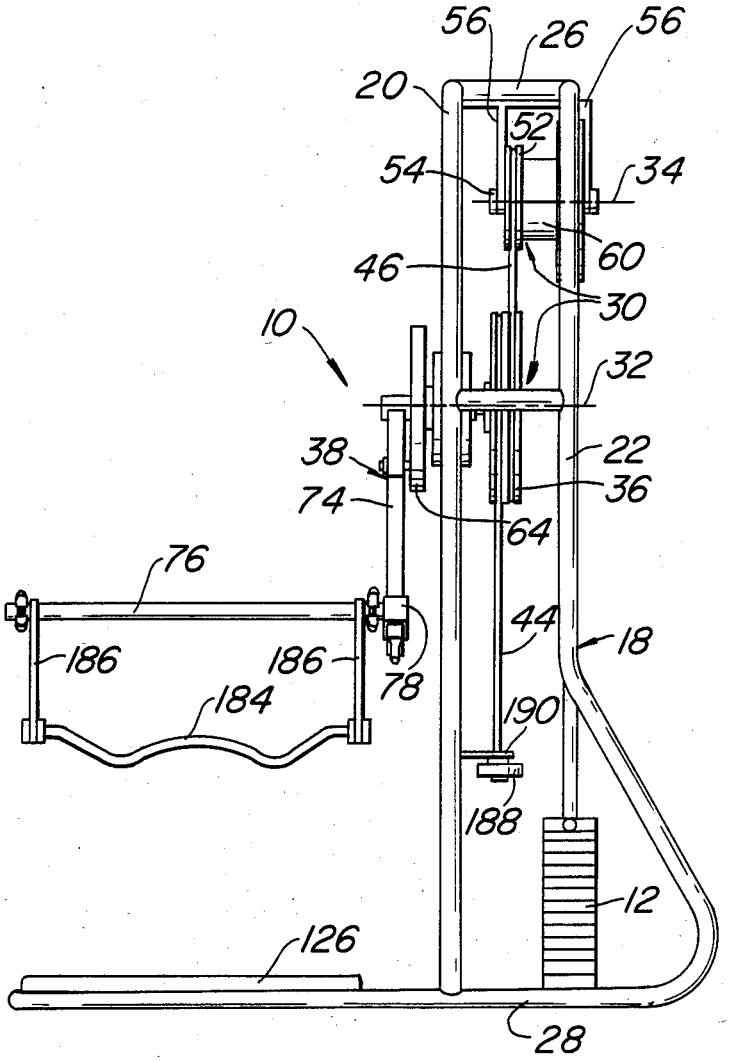

Referring now to FIG. 10, there is shown an embodiment of exercise system 10 which merely provides for removal of pad member 87 from user interface bar member 76. As is seen in FIG. 10, exercise bar 184 is coupled to flange xembers 186.

System 10 provides for a means whereby second cable 46 and third cable 62 are maintained in a taut condition independent of the vertical adjustment of rotative pulley mechanism 30. As can be seen in FIGS. 1 and 2, when rotative pulley mechanism 30 is vertically displaced in an upward direction, counterweight element 188 is movably displaced in an upward manner. Counterweight element 188 may be attached to first cable member 44 through an opening in stop member 190. Stop member 190 is rigidly secured to base frame 18 by bolting, screws, or some like technique, not important to the inventive concept as is herein described.

As can be seen in FIG. 5, when rotative pulley mechanism 30 is upwardly displaced, first pulley member 36 rotates in direction 50 which has the effect of downwardly displacing counterweight element 188 responsive to first cable 44 being unwound on first pulley member 36. Responsively, second cable member 46 is wound onto first pulley member 36 thereby maintaining cable members 46 and 62 in a taut condition upon vertical displacement of first pulley member 36.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended Claims.

What is claimed is:

1. A multi-function exercise system for reversibly displacing at least one weight element in a substantially vertical direction responsive to a lifting force imparted to said weight element by a user, comprising:

(a) a base frame;
(b) rotative pulley means displaceably coupled to said base frame and at least one weight element, said rotative pulley means having a first pulley axis and a second pulley axis;
(c) actuating bar means coupled to said rotative pulley means for rotationally displacing said rotative pulley means and linearly displacing said weight element responsive to a rotative force applied by said user;
(d) means for vertically adjusting said rotative pulley means with respect to said base frame said vertical adjusting means for displacing said first pulley axis reversibly in said vertical direction, said second pulley axis being non-displaceable in said vertical direction; and,
(e) means for rotationally adjusting said actuating bar means with respect to said rotative pulley means about said first pulley axis.

2. The multi-function exercise system as recited in claim 1 where said rotative pulley means includes:
(a) a first pulley member secured to said actuating bar means, said first pulley member being rotatable about said first pulley axis;
(b) a second pulley member rotatively coupled to said first pulley member, said second pulley member being rotatable about said second pulley axis; and,
(c) a third pulley member secured to said second pulley member and said weight element, said third pulley member being rotatable about said second pulley axis.

3. The multi-function exercise system as recited in claim 2 where said second pulley member is elliptically contoured throughout a predetermined section of a circumferential peripheral boundary.

4. The multi-function exercise system as recited in claim 1 where said means for rotationally adjusting said actuating bar means includes:
(a) a disk member coupled to said rotative pulley means, said disk member having a plurality of arcuately displaced openings formed therethrough; and,
(b) means for releasably coupling said actuating bar means to said disk member.

5. The multi-function exercise system as recited in claim 4 where said means for releasably coupling said actuating bar means includes an actuating bar pin member insertable through an opening formed in said actuating bar means, said pin member being alignable with one of said disk member openings.

6. The multi-function exercise system as recited in claim 1 including means for linearly adjusting said actuating bar means in a direction substantially normal said first pulley axis direction.

7. The multi-function exercise system as recited in claim 6 where said actuating bar means includes:
(a) a first actuating bar member coupled to said rotative pulley means extending in said direction substantially normal said first pulley axis direction;
(b) a second actuating tubular member slidingly displaceable on said first actuating bar member; and,
(c) a user interface bar member fixedly secured to said second actuating tubular member, said user interface bar member extending substantially in said first pulley axis direction.

8. The multi-function exercise system as recited in claim 7 where said second actuating tubular member telescopingly engages said first actuating bar member.

9. The multi-function exercise system as recited in claim 8 including an actuating pin member insertable through alignable openings formed in said first actuating bar member and said second actuating tubular member for coupling said first actuating bar member to said second actuating tubular member.

10. The multi-function exercise system as recited in claim 1 where said means for vertically adjusting said rotative pulley means includes:
(a) a pair of transversely displaced vertically extending post members secured to said base frame; and,
(b) means for releasably coupling said rotative pulley means to said vertically extending post members.

11. The multi-function exercise system as recited in claim 10 where said means for releasably coupling said rotative pulley means includes:
(a) a pair of adjustment plate members positionally located on opposing sides of said post members, said rotative pulley means having a rotative shaft member extending through said adjustment plate members in a direction coincident said first pulley axis; and,
(b) spring loaded adjustment means mounted between said adjustment plate members for releasably engaging openings formed in said post members.

12. The multi-function exercise system as recited in claim 11 where said spring loaded adjustment means includes:
(a) at least one U-shaped channel member having opposing leg members; and,
(b) at least one spring biased pin member extending through said opposing leg members for insert into at least one of said openings formed in at least one of said post members.

13. The multi-function exercise system as recited in claim 12 including at least a pair of vertically displaced rotative bearings rotatively secured to at least one of said adjustment plate members, at least one of said post members being sandwiched between said rotative bearings and one of said leg members of said U-shaped channel member.

14. The multi-function exercise system as recited in claim 1 including seat means transversely displaceable with respect to said base frame for adjusting a user's positional location with respect to said base frame.

15. The multi-function exercise system as recited in claim 14 where said seat means includes means for releasably locking said seat means to a base surface.

16. The multi-function exercise system as recited in claim 15 where said seat means includes:
(a) a seat frame;
(b) a frame back portion rotatably coupled to said seat frame about an axis line substantially parallel said first pulley axis; and,
(c) a frame seat portion rotatably coupled to said seat frame about said axis line substantially parallel said first pulley axis.

17. The multi-function exercise system as recited in claim 16 where said back portion of said seat means includes:
(a) a seat back bar member rotatably secured to said seat frame; and,
(b) a V-shaped seat back bar member rigidly secured to said seat back bar member on opposing ends of said V-shaped seat back bar member, one of said arms of said V-shaped seat back bar member having a plurality of openings formed therethrough adapted for insert of a back seat pin member to contact said seat frame on opposing sides of said seat back bar member.

18. The multi-function exercise system as recited in claim 17 where said seat portion of said seat means includes:

(a) a seat bar member rotatably secured to said seat frame; and, (b) a V-shaped seat bar member rigidly secured to said seat bar member on opposing ends of said V-shaped seat bar member, one of said arms of said V-shaped seat bar member having a plurality of openings formed therethrough adapted for insert of a seat pin member to contact said seat frame on opposing ends of said seat bar member.

19. The multi-function exercise system as recited in claim 1 including counterweight means coupled to said rotative pulley means for providing vertical adjustability of said rotative pulley means with respect to said base frame.

* * * * *